United States Patent [19]

Leifheit

[11] Patent Number: 5,056,397

[45] Date of Patent: Oct. 15, 1991

[54] FIXED FINGERING DEVICE FOR FRETTED STRINGED MUSICAL INSTRUMENT

[76] Inventor: Eric S. Leifheit, 7451 E. 34th St., Tucson, Ariz. 85710

[21] Appl. No.: 445,007

[22] Filed: Dec. 4, 1989

[51] Int. Cl.[5] ..... G10D 3/00; G10D 3/04

[52] U.S. Cl. ..... 84/318; 84/315

[58] Field of Search ..... 84/319, 318, 314, 308, 84/315, 316, 317

[56] References Cited

U.S. PATENT DOCUMENTS

| | | | |
|---|---|---|---|
| 668,060 | 2/1901 | Shelton | 84/314 |
| 692,751 | 2/1902 | Winchell | 84/318 |
| 3,290,980 | 12/1966 | Fender | 84/307 |
| 3,447,411 | 6/1969 | Bloxsom | 84/264 |
| 3,599,524 | 8/1971 | Jones | 84/312 |
| 3,680,427 | 12/1990 | Valentino | 84/318 |
| 3,783,731 | 1/1974 | Pash | 84/173 |
| 3,933,077 | 1/1976 | Dunlop | 84/318 |
| 3,971,287 | 7/1976 | Ito | 84/453 |
| 4,006,657 | 2/1977 | Dunnette | 84/314 |
| 4,037,510 | 7/1977 | Ginex | 84/453 |
| 4,208,941 | 6/1980 | Wechter | 84/298 |
| 4,304,163 | 12/1981 | Siminoff | 84/314 |
| 4,671,156 | 6/1987 | Hathcock | 84/318 |
| 4,798,119 | 1/1989 | Leifheit | 84/314 |

*Primary Examiner*—L. T. Nix
*Assistant Examiner*—Eddie C. Lee
*Attorney, Agent, or Firm*—J. Michael McClanahan

[57] ABSTRACT

An inventive fixed fingering device adapted to secure a string of a guitar or other fretted stringed instrument at selected fret positions in order to quickly and easily vary the length of the string available for vibration to change the pitch when the string is plucked. The fixed fingering device describes a rectangular shaped block having formed through its width a transverse partial cylinder whose cylindrical side is open to the bottom of the device, the partial cylinder adapted to encompass and be secured to a selected fret on the fretboard, the transverse partial cylinder and the fret so shaped as to complement each other. In addition, lengthwise through the fixed fingering device is an opening through which is passed one of the strings. Lastly, a protruding lip is provided attached to the block shaped fixed fingering device to provide for lifting or levering the fixed fingering device off the fret by the operator's fingernail. A plurality of fixed fingering devices are provided, one for each of the strings. After use, the devices are slid down the string to rest at the string nut and out of the player's way.

18 Claims, 1 Drawing Sheet

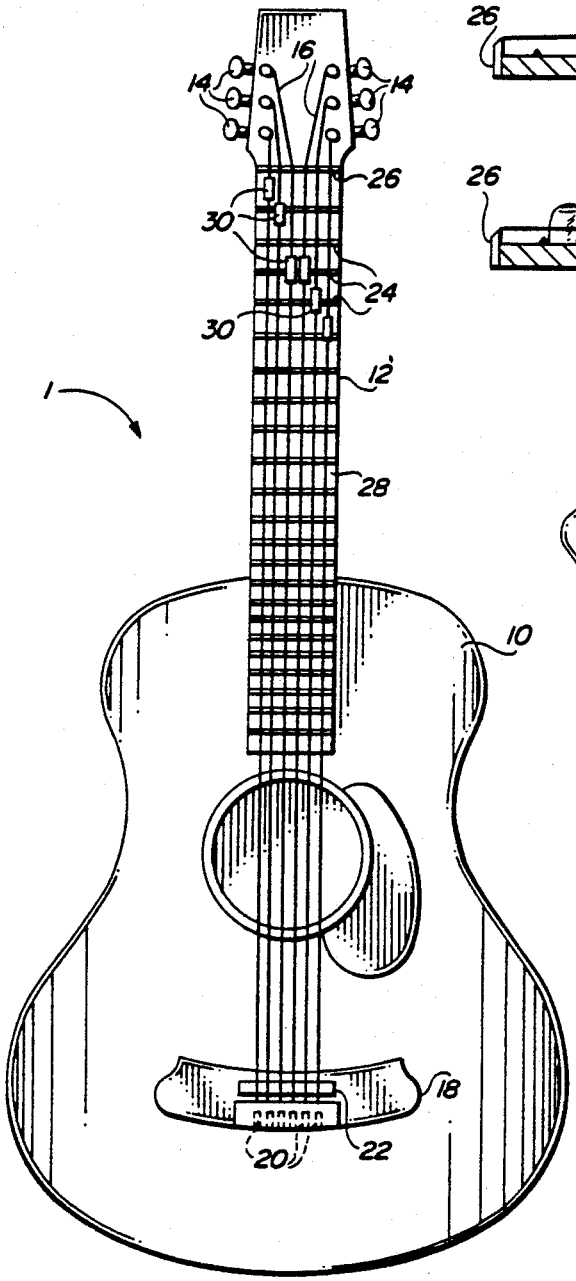
FIG. 1
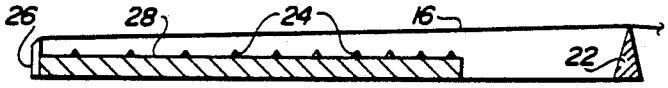
FIG. 2
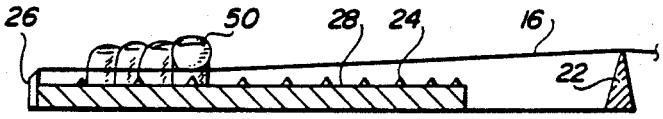
FIG. 3
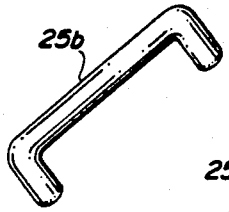
FIG. 4b
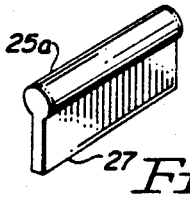
FIG. 4a
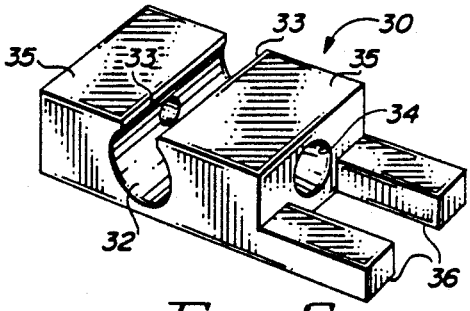
FIG. 6
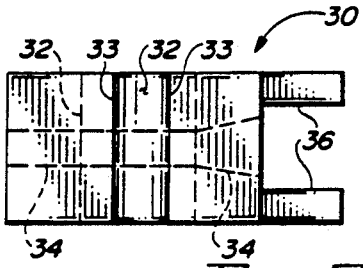
FIG. 7
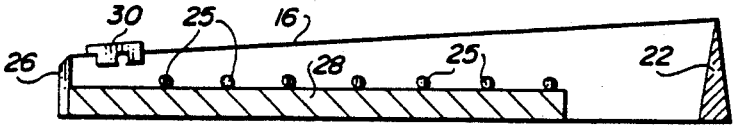
FIG. 5
FIG. 4
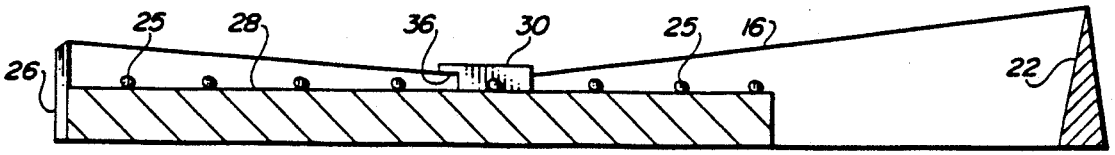

FIXED FINGERING DEVICE FOR FRETTED STRINGED MUSICAL INSTRUMENT

BACKGROUND OF THE INVENTION

1. Field of the Invention.

The field of the invention is means for fixing the fingering of a guitar string or other fretted stringed musical instrument string.

2. Description of Related Art.

In guitars and other fretted musical instruments, one or more strings are stretched under tension across a sounding board or other main body of the instrument which, upon the string vibrating, amplifies the sound of the vibrating string. One end of the string is anchored at one side of the main body or sounding board, the string then strung across the sounding board, and along an elongated neck portion attached to the main body. The other end of the string is then anchored at the end of the neck away from the main body to tuning pegs or other devices which permit adjustment of the string tension. At variously determined intervals along the neck portion are situated a plurality of frets, i.e., transverse ridges which underlie the plurality of strings, which frets are in turn resting upon a fretboard.

The strings do not touch the frets, even during vibration.

The sound emitted from a plucked string is termed its pitch and is determined by the relationship of the tension of the string, its mass per unit length (which is a function of the string's diameter), and the length of the string available for vibration (effective length). The effective length of the string is the distance between a first anchor, called the bridge, attached at the head of the main body of the fretted stringed instrument, and a second anchor, called the string nut, attached at the far end of the neck. Many times, all the strings ride over a saddle which is immediately adjacent to the bridge. The effective length in which case then starts at the saddle. At the neck far end is the second anchor, the string nut, over which all of the strings pass and contact immediately before they are attached to the tuning pegs.

On guitars or other fretted stringed musical instruments it is common for the musician to use his hand not plucking or striking the strings to press upon one or more strings of the instrument with one or more fingers to cause the string to engage the frets along the neck of the guitar or other musical instrument.

To easily change the pitch of the string, one merely shortens the string. To accomplish this, the player need only to press down on the string to cause it to engage one of the frets on the fretboard portion of the neck of the instrument. This procedure reduces the effective string length to the distance between the saddle and the fret. As a general rule, the 12th. fret on a guitar is located one-half of the distance between the saddle and the string nut. Then, if the string is held at the 12th. fret, the pitch doubles. A violinist or guitar player is constantly fingering the instrument as he plays it, using the fingers of the hand not plucking the strings (or drawing a bow across the strings) to change the pitch as called for by the musical score.

A prior invention by the instant inventor for a positioner acting as a fixed fingering device was granted by the United States Patent Office on Jan. 17, 1989 and accorded U.S. Pat. No. 4,789,119 concerned threaded inserts strategically placed in the fretboard, the inserts receiving machine screws which cupped the string under its head. By screwing down the machine screw securely into the insert, the screw would secure the string over the fret. However, such device, while very adequately performing the job, took some period of time for the player to unscrew the screws to a position above the height of the string, and then screw the screws down over the string. Such adjustment might easily be made between musical numbers, however, perhaps it did require too much time to secure a string during a musical number or, during the musical number, to unsecure a string.

It has been determined that it would be useful to have a device which mechanically fingers one or more strings of a stringed instrument for a changed, but constant pitch, during a whole musical number or a portion of one while at the same time making the remainder of the instrument strings, including the mechanically fingered string, still available for further non-mechanical fingering by the musical player. It is to this invention that the subject patent is directed.

It would also be useful if such a device could be placed or removed in a very short period of time, perhaps in less than a second or two.

SUMMARY OF THE INVENTION

The invention relates to a device for mechanical fingering of a fretted stringed musical instrument such as a guitar, violin, ukulele, or the like. Fingering is accomplished by the process of shortening one or more strings of the musical instrument to produce a pitch different than its usual unaltered frequency.

The postioning devices or fixed fingering devices of the invention which are the means to mechanically finger the stringed instrument include a specially designed device placed upon a raised fret on the fretboard of the stringed instrument neck. The device which is somewhat rectangularly brick shaped is so fashioned that it resides at all time upon a string of the musical instrument, and by means of a lengthwise opening is slideable along the string whereupon, when it is desired to secure a string at one of the frets over which the string passes, the device is slid along the string to the selected fret and then the device is pushed down upon that fret, causing it to lock onto the fret, and thereby holding the string secured at that fret. To accomplish the above, firstly, the frets are modified by constructing them so they have a circular or rounded cross section which may be grasped and then, secondly, the frets are raised above the fret board so that the fret lies completely on top of the fret board.

Fashioned into the fixed fingering device at a transverse angle to the opening in which the string resides is a partial cylinder (or cylinder with an opening along its cylindrical periphery where it intersects a surface of the rectangularly shaped block), the partial cylinder adapted to be pushed down over to encompass the rounded fret sufficiently to hold the fixed fingering device to the fret and thereby secure the string at that fret.

When the fixed fingering device is not being used, it is slid to the rear of the fretboard neck at the position of the string nut. There is resides, completely out of the way, until it is needed by the musician.

In the preferred embodiment, all strings of the stringed instrument will have one fixed fingering device situated on each string. Obviously, the fixed fingering device will have to be threaded upon each string prior to stringing the instrument with its strings. Similarly, if one of the strings break, when the two portions of the string of the broken string are replaced with a new string, a fixed fingering device will need be threaded upon that new string.

To move the fixed fingering device from one fret to another, or to remove the fixed fingering device from a fret to its storage position proximate the string nut, a handle or lip is provided upon the fixed fingering device which receives the under portion of a person's fingernail allowing the person to lift the fixed fingering device off the fret with a motion of their fingernail directed away from the fretboard.

It is an object of the subject invention to provide a mechanical device for mechanically fingering a fretted stringed musical instrument.

It is another object of the subject invention to provide a mechanical device such that various lengths of a stringed instrument string can be fixed for different pitches of the strings of the instrument.

It is still a further object of the subject invention to provide a fixed fingering device for every string of the instrument to provide complete pitch selection of strings of a fretted stringed instrument.

It is still another object of the subject invention to provide a mechanical device for varying string pitch of a fretted stringed instrument where the device, when not being used, is out of the way of the vibrating strings and fingers of a player.

Other objects of the invention will in part be obvious and will in part appear hereinafter. The invention accordingly comprises the apparatus comprising the construction, combination of elements, and arrangements of parts which are exemplified in the following detailed disclosure, and the scope of the invention which will be indicated in the claims.

BRIEF DESCRIPTION OF THE DRAWINGS

For further understanding of the nature and objects of the present invention, reference should be had to the following detailed description taken in connection with the accompanying drawings wherein:

FIG. 1 is a top view of a fretted stringed instrument showing the invention in place;

FIG. 2 is a side view of one string of a simplified fretted stringed instrument;

FIG. 3 is a side view of one string of a simplified fretted stringed instrument showing a player fingering the string of the instrument;

FIG. 4 is a side view of one string of a simplified fretted stringed instrument showing the invention in place secured to one of the frets;

FIGS. 4*a* and 4*b* are perspective views of two embodiments of the modified fret.

FIG. 5 is a side view of one string of a simplified string instrument showing the invention placed at the rear of the fretboard so that it is not operating upon the string;

FIG. 6 is a perspective view of the subject fixed fingering device rotated over on its top so as to better show the elements of the invention; and FIG. 7 is a bottom view of the subject fixed fingering device.

In varoius views, like index numbers refer to like elements.

DETAILED DESCRIPTION OF THE PREFERRED EMBODIMENT

Referring now to FIG. 1, a top view of a fretted stringed instrument, here a guitar, is shown with the inventive fixed fingering devices in place. Firstly, guitar 1 comprises main boby 10 and connecting neck 12. Rotatably mounted at the distal end of neck 12 are a plurality of conventional tuning pegs 14 which permit adjustment of the string tension. Each peg 14 has a shaft associated with it around which is wrapped one end of a guitar string 16. Strings 16 ride over and are supported by string nut 26 near the end of neck 12. The other end of strings 16 are anchored to a bridge 18 by a plurality of conventional bridge pins 20. Strings 16 ride over and are supported by bridge saddle 22. The string effective length, i.e., that length available for vibration, is the length between the string nut 26 and the bridge saddle 22 providing the string has not been secured at a fret. In such case, the effective length then becomes the distance between the bridge saddle 22 and the fret.

Situated upon the neck 12 is the fretboard 28 which constitutes the top surface of neck 12, and is immediately underneath, but not touching, strings 16. Mounted at spaced intervals upon fretboard 28 are frets 24 which protrude spatially above fretboard 28, but also do not engage guitar strings 16, even when the strings vibrate. Thus, in the illustration shown in FIG. 1, each of the six guitar strings are supported at opposite ends by bridge saddle 22 and string nut 26 with a string held at various frets by the invention 30.

The invention is shown situated above the fretboard 28 with all but one of the devices 30 engaging various frets 24 proximate the distal end of neck 12. These comprise the means by which strings are mechanically fingered. The inventive fixed fingering devices 30 are situated upon the guitar strings 16 and secured over selected frets 24 in order that when one or more are used, they will secure the individual strings at chosen frets and if properly initially aligned, do not shift the strings laterally as they secure the individual strings.

FIG. 2 is a side view of a guitar or other fretted stringed instrument showing in a simplified manner the various elements between the bridge saddle 22 and the string nut 26. Fretboard 28 located on the neck of the guitar has the plurality of frets 24 spaced along it according to a predetermined mathematical formula. Frets in the usual stringed instrument are upward protruding ridges which transversely cross the fretboard. String 16 is elevated above both the fretboard 28 and each of the frets 24. Frets are commonly named in consecutive order as the first fret, second fret, third fret, etc., commencing with the first fret next to the string nut. Shown in FIG. 2 is the first fret through the tenth fret. As a general rule (although not shown in simplified FIG. 2), the twelfth fret falls halfway between the string nut 26 and the bridge saddle 22.

The height of guitar string 16 above fretboard 28 and frets 24 is determined by the heights of string nut 26 and bridge saddle 22. Since most guitars have six strings which generally range in thickness between 0.010 to 0.050 inches and are under different tensions such that each string has a chosen particular vibrating frequency or pitch, sufficient allowance for these factors must be taken into consideration when determining the height of the string nut and bridge saddle. Other fretted stringed instruments have the same or similar considerations.

The vibrating frequency of a guitar string is changed when the guitar player holds or fingers one or more strings against a fret as shown in the example of FIG. 3. Here, the player has placed his finger 50 upon string 16 at the third fret. In doing so, the effective length of the vibrating string is now from the bridge saddle 22 to the point where the finger holds the string against the third fret whereas previously, the effective lenght of string 16 was the distance between bridge saddle 22 and string nut 26. In addition, by pushing string 16 down, the tension in string 16 has been slightly increased. Accordingly, the vibrating frequency, and thus pitch, of string 16, being a factor of effective string length, string mass (determined by the string thickness), and tension, results in a different pitch than was the case before the string was forced to engage the third fret. The guitarist then strums or plucks the strings between bridge saddle 22 and the area of the fretboard 28 closest to the bridge saddle to create the sound.

If one has watched a guitar player, it is noticed that the player strums or plucks the guitar strings with one hand while the other hand is moving up and down the guitar neck holding different strings at different frets. By such maneuvers, different pitches and sounds emanating from the strings are produced, and one string may theoretically take on as many different pitches as there are frets on a guitar. It is not necessary to hold the string exactly against the fret as shown in FIG. 3 as it is apparently obvious that if the person's finger, or fingers, were placed between the third and the second fret of FIG. 3, string 16 would still rise up upon the third fret which would then determine the length of the string available to vibrate. If, in the simplified example shown in FIG. 3, string 16 were to be pressed down to the fretboard 28 between the third and second frets, the tension would increase in string 16 over that shown in FIG. 3 because the string would have been stretched a little farther in being urged to the top of the fretboard rather than the top of the fret. How much pitch a string would change from a desired new pitch would obviously be a function of a number of factors including, but not limited to, the height of fret 24 above the fretboard 28. These are matters which may be compensated for in different ways, such as by location of the frets. In addition, it may be that the pitch of a string is not appreciably changed since the square root of the tension is used in calculating the vibrating frequency.

There are occasions when the guitar player wishes to play a musical number with one or more of the strings having a modified or changed pitch which is then to remain constant throughout the musical number. This may be accomplished very simply by the guitar player placing his fingers at the appropriate frets for the appropriate strings and leaving his hand there throughout the musical number. However, since generally only four fingers are available to the player, and most guitars have six strings, only four strings could be held against different frets unless one finger is holding more than one string. Normally, the thumb is not used to hold a string down. Even then, the guitar player is limited by the dexterity of his fingers and the length of his fingers as to which strings and frets will be involved. Further, if the guitar player is holding the strings constantly against the frets during the playing of the musical number, he can't be moving that hand up and down changing the pitch of the vibrating strings from the pre-chosen pitch.

This is where the instant invention shows its function and usefulness. FIG. 4 is a simplified view of a guitar and string such as illustrated in FIGS. 2 and 3 where the inventive fixed fingering device now holds a guitar string down at a selected fret position to achieve a specific pitch for that string. In addition, if desired, that same string may have its pitch further modified by the guitar player fingering the string against a fret nearer the bridge saddle 22. Referring specifically to FIG. 4, fixed fingering device 30 is shown securing guitar string 16 in place at the 5th fret located on fretboard 28. Now string 16 is firmly held to the 5th fret, similarly as when finger 50 shown in FIG. 3 held string 16 at the 3rd fret, and thus the resulting pitch of string 16, when plucked, is the newly desired pitch, the same as would be achieved by the string of FIG. 3 if the finger had been at the 5th fret. It is noted in FIG. 4 that the frets previously shown in FIGS. 2 and 3 have now been changed inasmuch as new frets 25 no longer take the appearance of the usual fret, namely a rod with a triangularly shaped top crossing the fretboard, but now new modified frets 25 are shown having a circular cross section and also being raised completely above fretboard 28. The reason for this is so that the fixed fingering device 30 will be able to grasp the frets 25 in order to hold string 16 at that position.

It is obvious that the modified frets 25 may be constructed and attached to the fretboard by any one of a number of ways, not the least being a round rod **25*b* as shown in FIG. 4*b* attached at opposite sides to the fretboard by having the fret bent over into the shape of a "U" wherein the legs of the "U" penetrate into the fretboard where they are held by an adhesive or by friction, with the bottom part of the "U" being the rounded portion crossing atop the fretboard at a right angle. Or, modified frets 25, having a rounded top as shown in FIG. 4*a* by numeral 25*b* are attached to an rectangular elongated base 27, the base 27 then secured at right angles into the fretboard also by an adhesive. This is more closely akin to present day systems. In this latter case, fret 25*a* would not be complete circle, but would be substantially a complete circle but still adapted to be encompassed by the partial cylinder of the fixed fingering device. The fixed fingering device 30 is shown in FIGS. 5–7** hereafter.

FIG. 5 is a side view of a simplified guitar with one string including the present invention showing the positioning of the fixed fingering device 30 when not in use. In FIG. 5, the fixed fingering device has been slid along string 16 to the rear of the neck of the guitar so that it resides upon the string but rests near or against string nut 26 and thus well out of way of the guitarist's fingers and hands so as not to present an obstruction.

From FIGS. 4 and 5, it can be seen that when it is desired that a string should be secured at a certain fret in order to change the pitch of that string, all one need do is to reach down to the area near the string nut for the fixed fingering device on the particular string sought and to slide the fixed fingering device from its location near the string nut to the particular fret about which the string is to be secured. Then, by locating the fixed fingering device over the fret, and in particular locating the transverse partial cylinder over the fret, and by pushing down the fixed fingering device upon the particular fret, the slot formed by the edges of the transverse partial cylinder in the flat surface of the block engages the fret causing the cylinder to expand (by the fixed fingering device bending at the point proximate the formed partial cylinder) such that the transverse partial cylinder in the fixed fingering device may closely surround and tightly encompass the rounded fret. The fixed fingering device is thereby secured upon the fret and, by virtue of the string passing through the fixed fingering device, the string is also secured at the fret to accomplish the task.

To remove the fixed fingering device from its position on a fret, as seen in FIG. 4, one merely needs to place their fingernail under the forward protruding lip 36 of the fixed fingering device (just beside the string) and pull outward (or upward) away from the fretboard causing the transverse partial cylinder in the fixed fingering device to slip off the rounded fret and become free of the fret. It will still, however, reside upon the string. The different elements of the fixed fingering device are more fully shown in the following two figures, FIGS. 6 and 7.

Referring now to FIG. 6, a perspective view of fixed fingering device 30 is shown where, for best viewing, the device has been rotated along its longitudinal axis by 180 degrees from the position shown in FIGS. 4 and 5. If you will, the fixed fingering device shown in FIG. 6 is upside down or rotated over upon its top. In FIG. 6, it is seen that the fixed fingering device is primarily a rectangularly shaped block, somewhat like a building brick or game domino, having a length, width, and thickness, formed preferably of a durable and resilient plastic. Formed widthwise through the thickness of the rectangular block is the means by which the fret is grasped, namely a hole or opening termed the transverse partial cylinder 32, so positioned that if the lower slot opening 33 were not formed by the walls of the cylinder and the lower surface 35, the cylinder 32 would just about be tangent to or break into (intersect) the lower surface 35 (shown as an upper surface in FIG. 6) of the fixed fingering device. However, to allow the transverse partial cylinder 32 to encompass the rounded fret, lower slot opening 33 is cut between the adjacent surface and the cylinder to open the transverse partial cylinder 32 to entrance of the fret.

Next, means for holding the string is detailed, namely longitudinal string opening 34 formed lengthwise or longitudinally through the rectangular shaped block comprising fixed fingering device 30, longitudinal string opening 34 being the opening which receives one of the strings of the stringed instrument. Opening 34 is enlarged or beveled at its entrance to a point near where it intersects the transverse partial cylinder and then proceeds through the complete length of the fixed fingering device, exiting on its back face. Obviously, the string of the stringed instrument must be fed through the longitudinal string opening 34 before the string is placed and secured upon the stringed instrument. Lastly, protruding lip 36, here split to allow for the expanded entrance to opening 34, is a result of a notch formed across fixed fingering device 30, formed to allow a person to place their fingernail under either side of this lip to lift the fixed fingering device 30 off of a selected fret when it is desired to remove it. The lip is, in its horizontal surface portion, at or near the same level as the string, however, because it is on both sides of the string, there is ample room for a person's fingernail to go under it. Also, the longitudinal string opening 34 intersects the bottom of transverse partial cylinder 32 so as to clamp the string against a fret to avoid buzzing.

Since the diameter of the strings vary, either the longitudinal string opening 34 should be sized for a particular string, or if universal fixed fingering device is to be utilized, the minimum diameter of the longitudinal string opening 34 needs to be greater than the diameter of the greatest string of the stringed instrument.

FIG. 7 is a bottom view of the subject fixed fingering device showing even more clearly the rectangular box shape of the invention and detailing firstly, the transverse partial cylinder 32 with lower slot opening 33 on both sides, the dotted line on either side of lower slot opening 33 being the opposite sides of the transverse partial cylinder 32. On the right hand portion of the figure is split lip 36, lip 36 being devided by longitudinal string opening 34 with its beveled entrance which, as can be seen in FIG. 7, runs the entire length of the fixed fingering device. Belling the entrance of opening 34 prevents the string from buzzing, i.e., hitting against an object when it is vibrating.

While for convenience the fixed fingering devices have been shown operating in the end portion of neck 12 of FIG. 1, it is realized that the fixed fingering devices may be slid along the string 16 throughout the whole length of the fretboard 28, usable from the first fret through the last.

FIGS. 1, 4, and 5, the invention has for clarity been shown slightly enlarged relative to the stringed instrument. As can be seen by FIG, 6 and 7, the fixed fingering device in the preferred embodiment is only 4 to 5 times longer than the thickness of the fret which may be in the order of 0.050 to 0.100 inch.

Advantages of the invention are, among others, that the player is able to do chords which would have been impossible to do due to the limitation of numbers of fingers and stretch of fingers. In addition, sympathetic vibration of adjacent string is also enhanced by virtue of the fact that the player can secure selected adjacent strings to maximize harmonic relationships.

While a preferred embodiment has been shown and described, it will be understood that there is no intent to limit the invention by such disclosure, but rather it is intended to cover all modifications and alternate constructions falling within the spirit and the scope of the invention as defined in the appended claims.

I claim:

1. On a fretted stringed musical instrument having a vibrational length of string stretched between two points overlying a plurality of frets on an instrument fretboard surface, a fixed fingering device to mechanically finger the string to selectively vary the string vibrational length and pitch comprising:

a device to secure the string at a selected position on the fretboard to selectively vary the vibrational length of the string, said device including means to substantially encircle a selected fret to secure said device to the fret, and means operably holding the string whereby said device secures the string to the selected fret.

2. The fixed fingering device as defined in claim 1 wherein said device comprises a rectangularly shaped block having formed therein said means to operably hold the string and said means substantially encircling the selected fret.

3. The fixed fingering device as defined in claim 2 wherein said means operably holding the string includes a first opening formed in said rectangularly shaped block, said first opening receiving the string therethrough.

4. The fixed fingering device as defined in claim 3 wherein said means formed in said rectangularly shaped block to secure said device to the fret defines a second opening formed in said rectangularly shaped block, said second opening substantially encompassing the selected fret to thereby secure said block to it.

5. The fixed fingering device as defined in claim 4 wherein said rectangularly shaped block has a length, width, and thickness, and said first opening is formed lengthwise through said rectangularly shaped block thickness.

6. The fixed fingering device as defined in claim 5 wherein said second opening is formed widthwise through said rectangularly shaped block thickness.

7. The fixed fingering device as defined in claim 6 wherein said rectangularly shaped block has a first surface defined by said length and by said width, said first surface intersecting said second opening whereby when said first surface of said rectangularly shaped block is pushed down over a fret of a stringed instrument, the fret is caused to forcibly enter said second opening.

8. The fixed fingering device as defined in claim 7 wherein said second opening conforms to the fret to closely surround and be secured to the fret of the stringed instrument whereby the rectangularly shaped block, being secured to the fret by the second opening, thereby secures the string at the selected fret.

9. The fixed fingering device as defined in claim 8 wherein said first opening running lengthwise through said rectangularly shaped block has an opening to receive the string, said opening having an enlarged beveled entrance, and said first opening and said second opening running widthwise through said said rectangularly shaped block intersect each other.

10. The fixed fingering device as defined in claim 8 wherein said rectangularly shaped block further includes a lip, said lip notched out from said rectangularly shaped and adapted to be engaged by a stringed instrument player's fingernail to lift said fixed fingering device off the fret.

11. On a fretted string musical instrument having a vibrational length of string stretched between two points overlying a plurality of frets on an instrument fretboard surface, in combination, a fixed fingering device to mechanically finger the string to selectively vary the string vibrational length and pitch, and a plurality of frets, the combination comprising:

a plurality of frets operably attached at spaced intervals to the stringed instrument fretboard; and a fixed fingering device to secure the string at a selected fret position on the fretboard to selectively vary the vibrational length of the string, said device including means to engage by subastantially encircling one of said plurality of frets to secure the string at a selected fret position on the stringed instrument fretboard.

12. The combination as defined in claim 11 wherein said fixed fingering device to secure the string at a selected position defines a rectangularly shaped block having found therein said means to engage said fret and said rectangularly shaped block also having means operably holding the string.

13. The combination as defined in claim 12 wherein said means operably holding the string defines a first opening formed in said rectangularly shaped block, said first opening receiving the string therethrough, and said means to engage said fret defines a second opening formed in said rectangularly shaped block, said second opening substantially encompassing said fret of secure said block to said fret.

14. The combination as defined in claim 13 wherein said recstangularly shaped block has a length, width, and thickness, said first opening formed lengthwise through said rectangularly shaped block thickness, and said second opening is formed widthwise through said block thickness, said second opening at right angles to said first opening.

15. The combination as defined in claim 14 wherein said rectangularly shaped block has a first surface defined by said length and by said width, said first surface intersecting said second opening whereby when said first surface of said rectangularly shaped block is pushed down over said fret, said fret is caused to forcibly enter said second opening.

16. The combination as defined in claim 15 wherein said fret comprises an elongated rounded rod and said second opening is similarly rounded to closely encompass and engage said fret to secure said rectangularly shaped block to said fret when said fret is caused to forcibly enter said second opening.

17. The combination as defined in claim 15 wherein said fret comprises an elongated rounded rod attached to an elongated base, said base attached to said fretboard, and said second opening is similarly rounded to closely encompass and engage said fret to secure said rectangularly shaped block to said fret when said fret is caused to forcibly enter said second opening.

18. The combination as defined in claim 15 wherein said fret is an elongated rod having a defined cross section, and said rectangularly shaped block second opening has an identically defined cross section, said rectangularly shaped block second opening encompassing and engaging said fret to secure said rectangularly shaped block to said fret when said fret is forcibly caused to enter said second opening.

* * * * *